US008448933B2

(12) United States Patent
Haug

(10) Patent No.: US 8,448,933 B2
(45) Date of Patent: May 28, 2013

(54) DEVICE FOR PROCESSING AND/OR TRANSPORTING FLAT MAIL ITEMS

(75) Inventor: Thomas P. Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 405 days.

(21) Appl. No.: 11/715,827

(22) Filed: Mar. 8, 2007

(65) Prior Publication Data

US 2007/0222135 A1 Sep. 27, 2007

(30) Foreign Application Priority Data

Mar. 8, 2006 (EP) ..... 06405106

(51) Int. Cl.
*B65H 5/00* (2006.01)

(52) U.S. Cl.
USPC ..... 271/10.11; 271/125

(58) Field of Classification Search
USPC ..... 271/10.11, 121, 122, 125
See application file for complete search history.

(56) References Cited

U.S. PATENT DOCUMENTS

| | | | | |
|---|---|---|---|---|
| 3,771,783 | A * | 11/1973 | McInerny | 271/125 |
| 4,429,866 | A * | 2/1984 | Castro-Hahn | 271/266 |
| 4,573,673 | A | 3/1986 | Haug et al. | |
| 4,718,809 | A * | 1/1988 | Krasuski et al. | 414/797.7 |
| 5,725,208 | A * | 3/1998 | Miyauchi | 271/10.09 |
| 6,102,388 | A * | 8/2000 | Thornhill | 271/119 |
| 2004/0080094 | A1 * | 4/2004 | Dopfer | 271/122 |
| 2004/0212141 | A1 * | 10/2004 | Graef et al. | 271/121 |

FOREIGN PATENT DOCUMENTS

| | | | |
|---|---|---|---|
| DE | 99 920 | | 11/1898 |
| EP | 0 856 483 | | 8/1998 |
| EP | 1832536 | A1 * | 9/2007 |
| FR | 2 210 181 | | 7/1974 |
| JP | 07038703 | A * | 2/1995 |

* cited by examiner

*Primary Examiner* — Michael McCullough
(74) *Attorney, Agent, or Firm* — Lucas & Mercanti, LLP; Klaus P. Stoffel

(57) ABSTRACT

A device for processing and for transporting flat mail items such as documents and/or letters inserted into envelopes, samples, cards, etc., includes a transport route, formed by transport rolls (5, 6, 7) of a transport mechanism (3), one end of this route being configured to load a separation unit (9) with mail items (2) for individual processing. The device includes a separation unit (9), which is designed with a drive roll (6), supported rotatably on a horizontal axis of rotation and extending transversely to the transport direction. The drive roll acts frictionally on the bottom surface of the mail item (2) and cooperates with a queuing mechanism (11), which is installed above (6) and offset from the drive roll in the downstream direction to hold back excess mail items.

9 Claims, 2 Drawing Sheets

DEVICE FOR PROCESSING AND/OR TRANSPORTING FLAT MAIL ITEMS

BACKGROUND OF THE INVENTION

1. Field of the Invention

The present invention pertains to a device for processing and/or transporting flat mail items such as documents and/or letters inserted into envelopes, samples, cards, etc., along a transport route formed by a transport mechanism with transport rolls, one end of this route being designed to load a separation unit with mail items for individual processing.

2. Description of the Related Art

Such devices can be installed upline of, for example, a franking machine or other device for further processing.

EP 0 856 483 B1 discloses a mechanism of the type indicated above, which is installed upline of a franking machine and which has three sections arranged in a row along the transport route of the mail items, namely, a feed section for the items stacked in a magazine, a second, following section for separation and further transport of the items, and a third section, in which the items, especially envelopes, are closed and transported onward. In the second section for the selection and transport of the items, selection rolls and conveying means are provided, which cooperate with transport rolls connected to each other by a joint. For this purpose, the selection rolls and the transport rolls are connected to each other by a joint provided between them. This arrangement results in undefined movements, which limit the reliability of the device.

SUMMARY OF THE INVENTION

This circumstance creates the object on which the invention is based, namely, the object of creating a device of the same general type, but which is characterized by simplicity and reliability while offering the same performance quality.

According to the invention, this task is accomplished in that the separation unit has a drive roll,

- which acts by friction on the bottom surface of the mail item;
- which cooperates with a queuing mechanism installed above it to hold-back the excess mail items; and
- which extends transversely to the transport direction and is rotatably supported around a horizontal axis.

The invention takes a new approach and creates a simple arrangement and clear relationships for the separation of the individual mail items, which can be supplied stacked, lying on top of each other with an offset, fanned out, and/or fed individually.

The functional properties can be improved by designing the queuing mechanism and the drive roll in such a way that they form a slot-like or gap-like through-opening—which can also be called a feed opening, a pass-through opening, a conveyor gap, or the like—for the mail items, to assist the separation and transport of the items.

It is advantageous to design the queuing mechanism as a guide roll, which acts gently on the mail items and assists the transport process.

The cooperation between the drive roll and the guide roll can be determined and optimized by coordinating the geometries of their cross sections and their arrangement. The drive roll, for example, should have at least approximately the same effective diameter as the guide roll, so that a favorable infeed action of the rolls forming the infeed gap can be obtained.

Giving the rolls a relatively large diameter of approximately 60 mm or more creates a wide frictional contact surface on the drive roll for the mail items in question and helps to fan out the mail items resting on top of each other on the guide roll.

Shifting the axis of rotation, i.e., the diameter, of the guide roll several millimeters downstream in the transport direction from the axis of rotation of the drive roll improves the infeed action on the mail items and pulls the guide roll closer to the drive roll; in addition, the rolling frictional effect responsible for the transport of the mail items can be improved for the item at the bottom of the stack.

If the mail items are being supplied individually, one after the other, to the separation unit, however, the braking action will be overcome and the guide roll will rotate under the action of the mail items.

The rotatably supported queuing mechanism or guide roll is advisably subjected to a force which opposes the rotation of the roll in the transport direction, i.e., to a force which exerts a braking action on the queuing mechanism or guide roll.

A measure which improves the cooperation between the queuing mechanism or guide roll and the drive roll can consist in that the height of the queuing mechanism or guide roll can be adjusted, i.e., adjusted in the direction determined by the thickness of the mail items.

For this purpose, the queuing mechanism or guide roll can be designed so that it can be raised with respect to the drive roll.

The advantages of the invention are especially noticeable when the queuing mechanism or guide roll has a depression distributed over its width, which cooperates with the drive roll to form at least part of the pass-through opening. That is, the entire drive roll or the working width of the drive roll is narrower than the depression in the queuing mechanism or guide roll.

So that the mail items can be processed without damage, the drive roll can extend beyond the queuing mechanism or guide roll at least at one end.

For this purpose, it is advisable for the drive roll to have several roll bodies spaced a certain distance apart along its width, on which the mail items (of different formats) are transported.

In this respect it is advantageous for the queuing mechanism, designed as a guide roll, to have a depression, which is provided on its circumference and which cooperates with the drive roll, so that the mail items are not damaged in the pass-through opening.

To optimize the cooperation between the guide roll and the drive roll, the depression in the periphery of the guide roll is wider than the cooperating peripheral area of the drive roll, so that the transport effect experienced by the mail items is distributed over the entire width of the drive roll.

The separation of the mail items is further improved preferably by supporting the guide roll so that it can rotate freely and subjecting it to a force which opposes the rotational movement of the roll in the transport direction of the mail items, thus inhibiting this movement.

The force which inhibits the rotational movement of the guide roll can be easily supplied by means of a friction clutch. It is advantageous for this to be adjustable.

To optimize the feed of the flat mail items being supplied either in stacks or individually in a row, the drive roll or separation unit can be preceded by a feed roll, the peripheral velocity of which is slower that that of the drive roll, so that the mail items, after being gripped by the drive roll, are accelerated and conveyed as quickly as possible out of the effective range of the separation unit.

To assist the separation process, a stop device is provided, which slants backwards with respect to the transport direction of the mail items and which is mounted above the transport route of the mail items in front of the guide roll. The bottom edge of the stop device cooperates with the drive roll to form a relatively narrow gap or pass-through opening accommodating only a few mail items and has a fanning-out effect on the forward side of the queued stack of mail items.

So that the separated mail items can be transported away quickly from the separation area, it is proposed that the separation unit consisting of the drive roll and the queuing mechanism or guide roll be followed by two transport rolls, supported one above the other, forming a transport gap, at least one of these being a driven transport roll with a peripheral velocity greater than that of the drive roll. The drive rolls of the transport mechanism, which have a slower peripheral velocity than the downstream drive rolls, are designed to be free-wheeling in the transport direction of the mail items.

It is advantageous for the drive roll, the feed roll, and a transport roll to form a transport plane, on which the mail items are transported and on which they pass through the separation unit.

The transport function of the proposed device can be combined effectively with a letter-closing mechanism to form a system, where the letter-closing mechanism follows the separation unit.

When the device is set up to cooperate with the letter-closing mechanism, it is especially suitable to install it downstream from a franking machine with respect to the transport direction of the mail items.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
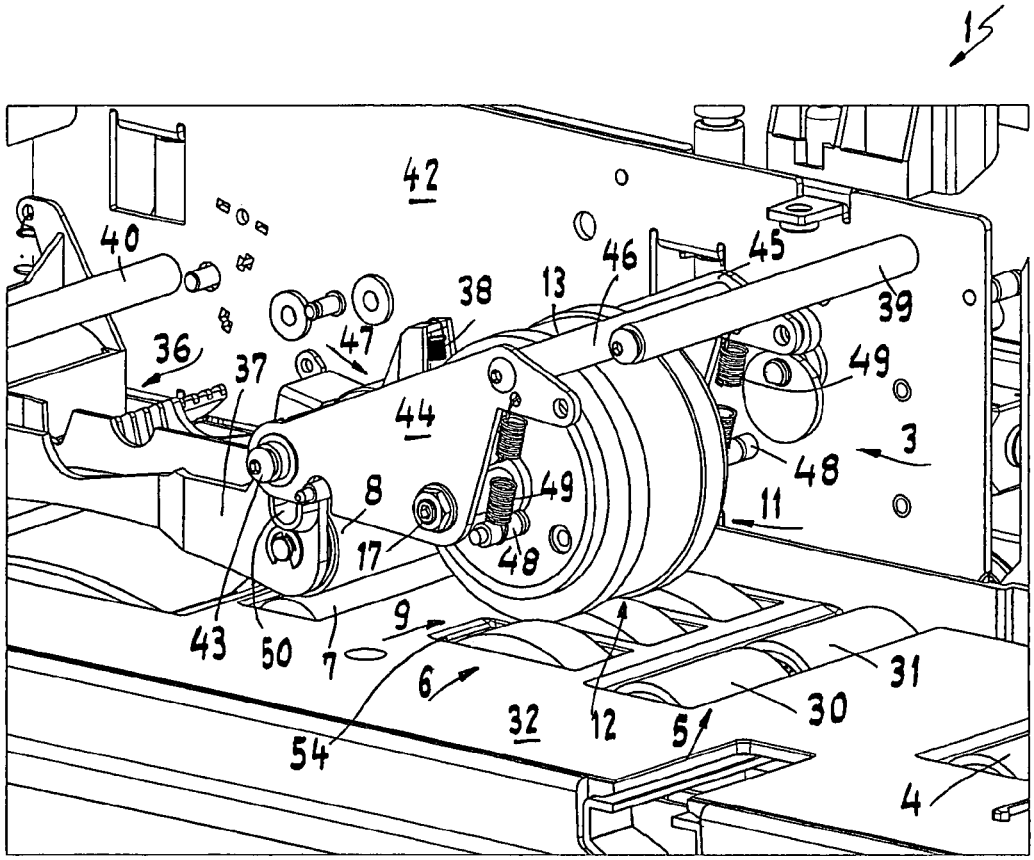
FIG. 1 is a perspective view of an inventive device, preferably representing one unit of a system as illustrated in FIG. 2.
Figure 2:
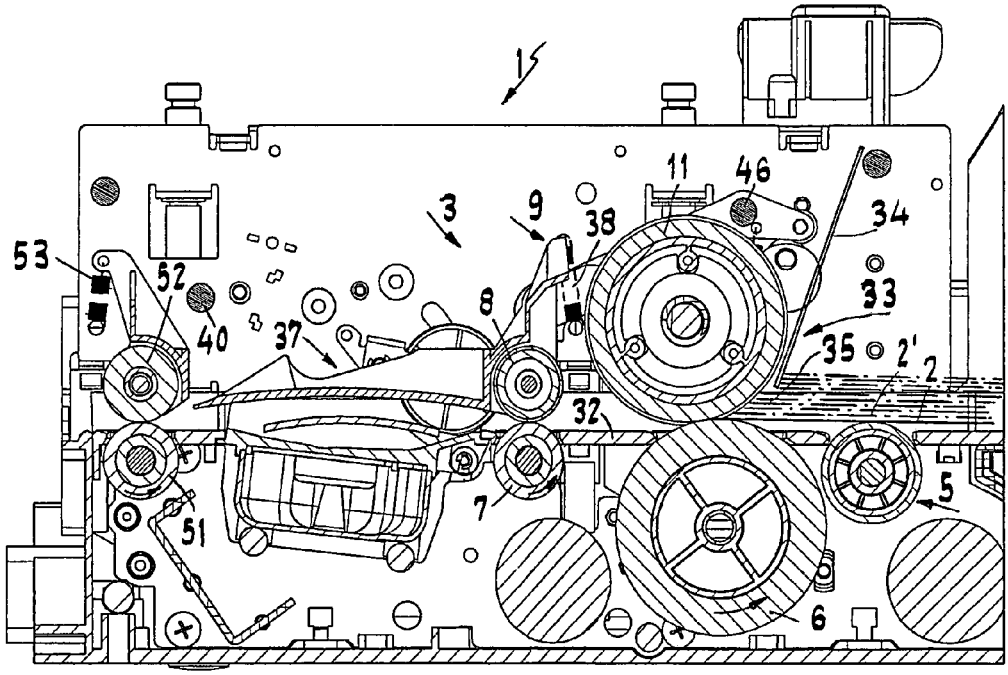
FIG. 2 is a longitudinal cross sectional view through a system consisting of a separation unit and a following letter-closing mechanism.
Figure 3:
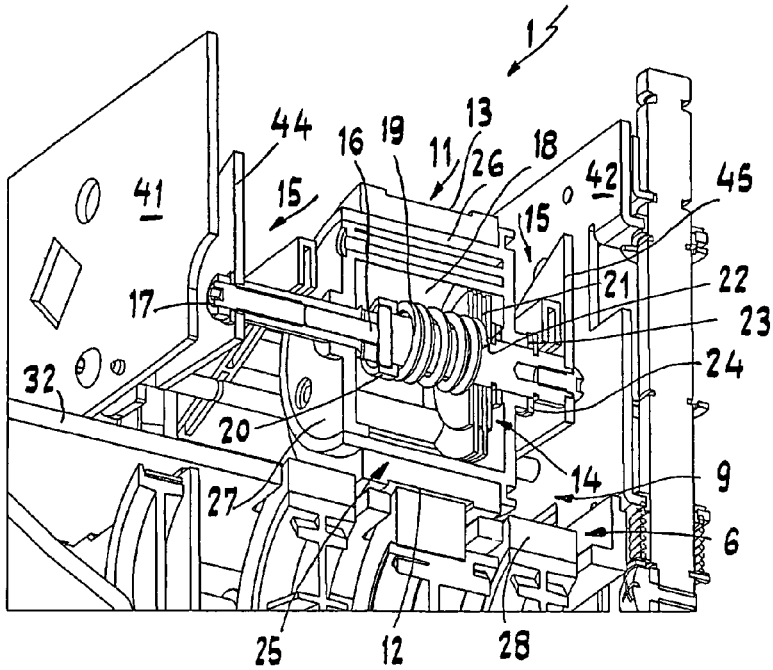
FIG. 3 is a perspective partial cross-sectional view, of the guide roll.

FIGS. 1-3 show a device 1 or parts thereof for processing and/or transporting flat mail items 2. Flat mail items include documents or letters inserted into envelopes, samples, cards, etc., of the same or different thickness. The device 1 has a transport mechanism 3, consisting of several transport rolls 4-8 forming a transport plane for the mail items 2 and determining a transport route for the mail items 2. One end of the transport route is designed to load a separation unit 9, which transports the stacked or individually supplied mail items 2 one after the other for further processing. The separation unit 9 consists of a drive roll 6, which is assigned to the transport mechanism 3. This roll acts by friction, i.e., nonpositively, on the bottom surface of the mail items 2. A queuing mechanism 11, offset in the downstream direction, which, according to FIGS. 1-3, is designed as a guide roll, holds back the excess mail items 2 arriving at the guide roll 11 and thus prevents double takeoffs. While idling, the guide roll 11 rests on the drive roll 6 and cooperates with it during the transport of the mail items 2, where the rolls 6, 11 are supported on horizontal axes transverse to the transport direction. The queuing mechanism 11, which could also be designed as a segment part of a roll, works together with the drive roll 6 to form a slot-like pass-through opening 12, through which the mail items, which are lying flat, pass. The guide roll 11 is also, but not necessarily, subjected to a resilient force, such as the force of a spring, so that, if necessary, it can be raised by the mail items 2, especially thick items 2, passing through the opening. The holding-back of excess mail items 2 is accomplished in that the queuing mechanism or guide roll 11 is braked by a force opposing the rotation of the roll in the transport direction. As a result, excess mail items 2 are prevented from arriving between the drive roll 6 and the queuing mechanism 11, i.e., multiple takeoffs do not occur. The queuing mechanism or guide roll 11 has a depression 13 distributed across its width (see also FIG. 4), so that a mail item 2 can be easily deformed as it passes through, i.e., can easily adapt to the change in contour. Both in the case of thin and in the case of thick mail items 2, 2', 2", the contours of the queuing mechanism or guide roll 11 located above the transport route assist the process by which the lowermost mail item 2 is separated from the items 2', 2" above it. The depression 13 is wider than the cooperating part of the drive roll 6. The drive roll projects beyond the guide roll 11 at both ends, so that a distributed, nondamaging transport effect can be exerted on the mail items 2.

Figure 4:
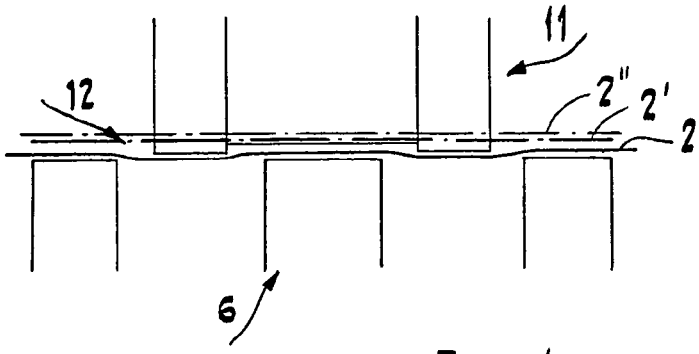
FIG. 4 is a schematic, cross-sectional view of the pass-through opening.

FIG. 4 show a view looking in the transport direction of the mail items. A mail item 2, which, lying partially on the drive roll 6, is passing through the through-opening 12, whereas the mail items 2', 2" lying on top of it are being held back by the forward edge of the queuing mechanism, i.e., the guide roll 11. As soon as the rear edge of the lowermost mail item 2 has reached the through-opening 12, the item 2' previously lying on top arrives in the effective area of the drive roll 6, which now transports this item 2' through the slot behind the pass-through opening 12. The queuing mechanism 11, designed according to the drawing as a guide roll, has a friction clutch 14, which is seated on a stationary axle 16 of the guide roll 11. The axle 16 is mounted in a frame 15. The clutch is connected at one end to the axle 16, and at the other end it is connected frictionally by means of adjacent plates 17 to the guide roll 11.

FIG. 3 shows a possible embodiment of the queuing mechanism or guide roll 11, which is seated on an axle 16. The axle itself is mounted in the frame 15. The axle 16, which is transverse to the transport direction of the mail items 2 and passes through the guide roll 11, is attached at the ends by screws 17 to the frame 15. The guide roll 11 has a hollow space 18 inside, in which a compression spring 19, surrounding the axle 16, of a friction clutch 25 is installed, resting at one end against a set collar 20. The opposite end of the compression spring 19 presses against several friction disks or plates 21 adjacent to each other on the axle 16, which rest in turn against a disk 27, connected to the interior end wall 22 of the guide roll 11. Alternatively, the guide roll 11 could be mounted on the axle 16 with freedom of axial movement and be pressed against a brake disk 24 installed on the axle 16 outside the housing 26 of the friction clutch 25 by the force generated by the compression spring 19 acting toward the inner end wall 22. To change the amount of friction, the housing 26 forming the hollow space 18 is provided with a removable disk 27, serving as a lateral bearing flange 27 of the guide roll 11.

The periphery of the guide roll 11 is provided with a surface layer 28 which assists the separation process; this surface layer is provided with a depression 13.

The transport rolls 4-7 or 8 of the transport mechanism 3 also have similar surface layers on their peripheries.

FIGS. 1 and 2 show a driven feed roll 5, which is upstream of the separation unit 9 and which consists of two roll bodies 30, 31 with axially separated peripheries, each having a frictionally active coating. Like the other transport rolls 4, 6, 7 of the transport mechanism 3 forming a transport plane, the surface of the feed roll 5 also projects a few millimeters beyond a flat cover 32, which is provided with openings 54 for the transport rolls 4-7. The feed roll 5 ensures that the lowermost mail item 2 of the stack will make contact with the drive roll 6, and a stop device 33, upstream of the separation unit 9 and slanting backward with respect to the transport direction, has the effect of pre-fanning the forward edge of the stacked mail items 2. The bottom edge of the stop device 33 with its stop surface 34 is far enough away from the transport plate of the mail items 2 that at least one mail item 2 or a few items of the stack—as described above—are queued up against the queuing mechanism or guide roll 11. The height of the stop device 33 is adjustable, so that the gap 35 formed between the bottom edge of the stop device and the transport plane can be varied. The peripheral velocity of the feed roll 5 is slower than that of the drive roll 6. So that no undesirable sliding friction develops between the mail item 2 and the feed roll 5 as a mail item 2 is being accepted by the drive roll 6 or separation unit 9 as a result of the higher peripheral velocity of the drive roll, the feed roll 5 is designed to freewheel in the transport direction of the mail items 2. The further transport of the mail items 2 downstream from the separation unit 9 is accomplished by the two transport rolls 7, 8, mounted one above the other. The two rolls thus form a transport gap for the mail items 2 passing through. The lower transport roll 7 is the driven roll, and its peripheral velocity is greater than that of the drive roll 6, which rotates in the same direction, so that the mail items are carried away at an accelerated rate downstream from the separation unit 9. The transport roll 8 above the transport roll 7 rotates freely on the upstream end, with respect to the transport direction, of a rocker 37, which belongs to a letter-closing mechanism 36. A tension spring 38 acting by way of this rocker presses the transport roll 8 down onto the mail items 2 passing through.

FIG. 1 also shows the arrangement of the queuing mechanism or guide roll 11 within the device 1. For this purpose, the frame 15, which has shields 41, 42 held a certain distance apart by spacers 39, 40, has a pivot axis 43, which is transverse to the transport direction of the mail items 2 and which is attached to the shields 39, 40. Two more-or-less triangular bearing plates 44, 45 are pivotably supported on this axis, one on each side of the guide roll 11, and are connected to each other by a tie rod 46 extending transversely to the transport direction of the mail items 2.

The bearing plates 44, 45 form a bearing block 47 for the guide roll 11, which can thus pivot around the pivot axis 43. The guide roll can, but does not necessarily have to be—as previously mentioned—pulled against the drive roll 6 by helical springs 49, which are attached to the bearing plates 44, 45 of the bearing block 47 and to an inward-projecting pin 48 on each of the shields 41, 42, so that the mail items 2 are separated gently and can pass through the separation unit 9 without interference. The essential point here is that the guide roll 11 can react independently to mail items 2 of different thicknesses and stiffnesses. At the upstream end with respect to the transport direction of the mail items 2, the rocker 37, which may or may not follow immediately after the transport rolls 7, 8 and which belongs to the letter-closing mechanism 36, is provided with vertically oriented oval slots 50, one on each side, through which the pivot axis 43 of the bearing block 47 passes and which limit the vertical movement of the rocker 37. The transport roll 8 mounted on the upstream end of the rocker 37 is pulled by the tension springs 38 against the driven transport roll 7, from which it can rise as the mail items 2 pass through. The freely rotating transport roll 8 is driven directly by the transport roll 7 or frictionally by the mail items passing through.

At the downstream end of the letter-closing mechanism 36, the rocker 37 has another transport roll 52, which cooperates with a driven transport roll 51 located underneath. This transport roll 52 is pressed by tension springs 53 against the transport roll 51 and can, as the mail items 2 are passing through, rise from the transport roll 51 in correspondence with the thickness of the mail items. The transport roll pair 51, 52 has more-or-less the same transport velocity as the transport roll pair 7, 8. Both pairs 51, 52; 7, 8 of transport rolls transport the mail items 2 through the letter-closing mechanism 36, which is part of the overall system illustrated in FIGS. 1 and 2.

The system can be installed as a transport unit upstream of a franking machine.

While specific embodiments of the invention have been shown and described in detail to illustrate the inventive principles, it will be understood that the invention may be embodied otherwise without departing from such principles.

I claim:

1. A device for processing and transporting flat mail items, documents and letters inserted in envelopes, samples, cards, comprising a transport route formed by a transport mechanism equipped with transport rolls, one end of the route being configured to load a separation unit with mail items for individual processing, wherein the separation unit has a drive roll, which acts frictionally on a bottom surface of a mail item;

cooperates with a queuing mechanism which holds back excess mail items; and extends transversely to a transport direction of the mail items and is rotatably supported around a horizontal axis, wherein the queuing mechanism and the drive roll form a slot-shaped pass-through opening, wherein the queuing mechanism includes a guide roll, wherein an axis of rotation of the guide roll is offset downstream from the axis of rotation of the drive roll with respect to the transport direction of the mail items, wherein the guide roll is arranged on the drive roll so as to be liftable away from the drive roll, wherein the guide roll is supported so as to be rotatable in the transport direction and is subjectable to a force which inhibits a rotational movement in the transport direction of the mail items, and wherein the force which inhibits the rotational movement of the guide roll is formed by a friction clutch, wherein the friction clutch has a compression spring supported on an axle, this spring acting on at least one plate, which rests against an interior end wall to guide the guide roll and produces friction upon rotation, wherein the friction clutch is located in a hollow space inside the guide roll, wherein the hollow space is formed by a two-part housing, one of the parts being formed as a removable bearing flange of the guide roll.

2. A device according to claim 1, wherein pressure of the compression spring is adjustable.

3. A device according to claim 1, wherein the guide roll is supported on an axle with freedom of rotation and axial movement, where the compression spring is mounted on the axle in the hollow space and acts on an end of the guide roll and to push the guide roll against a friction disk mounted on the axle.

4. A device according to claim 1, wherein the drive roll has at least approximately the same effective diameter as the guide roll.

5. A device according to claim 1, wherein the guide roll is mounted on a bearing block pivotably supported around a horizontal axis so that the guide roll can be pressed down toward the drive roll.

6. A device according to claim 1, wherein the drive roll extends beyond the guide roll at both ends thereof.

7. A device according to claim 1, with a feed roll upstream of the drive roll, wherein a peripheral velocity of the feed roll is slower than that of the drive roll.

8. A device according to claim 1, wherein a stop device extends across the transport route of the mail items upstream from the guide roll and slants backward from bottom to top with respect to the transport direction.

9. A device according to claim 1, and further comprising a franking machine installed downstream of the device with respect to a transport function of the device.

* * * * *